United States Patent [19]

Debard

[11] Patent Number: 4,770,323

[45] Date of Patent: Sep. 13, 1988

[54] STERILE PACKAGING OF LIQUID AND SEMI-LIQUID FLUIDS

[75] Inventor: André Debard, Buc, France

[73] Assignee: Aerosol Inventions and Development S.A. A.I.D. S.A., Fribourg, Switzerland

[21] Appl. No.: 10,735

[22] Filed: Feb. 4, 1987

[51] Int. Cl.[4] ..... B67B 7/48

[52] U.S. Cl. ..... 222/82; 222/83; 222/89; 222/382; 222/464

[58] Field of Search ..... 222/82, 83, 89, 90, 222/382, 464, 80, 81, 541, 401, 211, 380, 383

[56] References Cited

U.S. PATENT DOCUMENTS

| | | | |
|---|---|---|---|
| 1,795,510 | 3/1931 | Schanze et al. | 222/401 X |
| 1,921,411 | 8/1933 | Johann | 222/83 X |
| 1,929,564 | 10/1933 | Rolph | 222/382 X |
| 3,194,450 | 11/1963 | Brocklin | 222/394 |
| 3,208,639 | 9/1965 | Marwell et al. | 222/83 X |
| 3,270,919 | 4/1964 | Frangos etal. | 222/82 |
| 3,542,240 | 11/1970 | Solowey | 222/83 |
| 4,019,512 | 4/1977 | Tenczar | 222/80 X |
| 4,152,378 | 5/1979 | Vcelka et al. | 222/541 X |

FOREIGN PATENT DOCUMENTS

| | | |
|---|---|---|
| 1506685 | 12/1967 | France . |
| 2106991 | 4/1983 | United Kingdom . |

*Primary Examiner*—Joseph J. Rolla
*Assistant Examiner*—Nils E. Pedersen
*Attorney, Agent, or Firm*—Finnegan, Henderson, Farabow, Garrett & Dunner

[57] ABSTRACT

A sterile package for liquid and semi-liquid fluids comprises a container (1) containing the product to be dispensed (2). It is hermetically sealed by a breakable membrane seal (3) until first use, and includes an axial tube (4) extending from below the seal down to the bottom of the container (1). A dispensing head or cap (5)is fixed onto the neck (12) of the container and comprises a manually actuated member (6) for perforating the seal and for putting the dip tube into communication with a dispensing passage (7) which extends through the cap. The perforating member (6) is tubular, sliding axially and telescopically at one end of the dispensing passage (7). It comprises a snap-engagement mechanism (8) co-operating, at the end of its travel and after perforation of the seal (3), with complementary snap-engagement mechanism (10) on a fixed element of the package to cause the perforating member (6) to engage with the dip tube (4) in a positive sealing manner.

6 Claims, 3 Drawing Sheets

STERILE PACKAGING OF LIQUID AND SEMI-LIQUID FLUIDS

The present invention relates to the sterile packaging of fluid materials.

It concerns more particularly a method of packaging allowing the products to be kept isolated from the surroundings until first use and subsequently dispensing them. This type of package relates in particular to food products such as various sauces, notably 'ketchup', mustard, mayonnaise, edible creams and cosmetic creams, shampoos as well as all other products for various uses and liable to be affected as a result of contact with air during prolonged storage.

The packages used up to now for such products rely on sealing the container in which the product is present with a membrane such as a laminate of aluminum material and plastics which is heat-welded onto the mouth of the container. This type of sealing has shown itself in particular for packages of the so-called 'vacuum' type for freeze-dried products such as coffee powder.

A similar package has equally been used for perfume products mixed with a propellant gas in bottles hermetically sealed with an aluminum cap carrying a dip tube which extends down to the bottom of the container.

When the time comes for use, a dispensing head containing a valve and terminating in a spike is screwed onto the neck of the bottle and perforates the cap on the axis of the dip-tube on first utilization.

Such an arrangement, however, has the drawback that at each occasion of use, the spike tends to obstruct either totally or partly the hole in the cap which is formed initially, and this can hinder and even render impossible the dispensing of the product.

The aim of the invention is to eliminate the drawbacks of the above-mentioned standard arrangements and to allow the products in a container to be preserved out of contact with the atmosphere after sterilization or before sterilization and up until the first use without any obstruction, followed by long and repeated use.

The subject of the invention is a sterile package for liquid and semi-liquid fluids comprising a container which contains the product to be dispensed, hermetically sealed by a frangible membrane until first use and incorporating an axial dip tube extending from below the seal down to the base of the container as well as a dispensing head snapped onto the neck of the container comprising a manual actuating member for perforating the membrane and putting the dip tube in communication with a dispensing passage which passes through the head, the package being characterized in that the perforating member is tubular, sliding axially and telescopically at one end of the dispensing passage, and has snap engagement means co-operating at the end of its travel, and after perforation of the membrane, with complimentary snap-engagement means carried by a fixed element on the package for causing the perforating member to engage in a sealing and positive manner with the dip tube.

Preferably the engagement of the perforating member with the dip tube is maintained after snap-engagement under an axial elastic pressure exerted by axial deformation of an annular locating and maintenance component of the tube which engages by its periphery against the inside of the neck of the container.

In a modification the axial elastic pressure could be exercised by belling out the dip tube of which the non-abutting end is then notched and engages against the base of the container.

According to another modification the elastic pressure could be exercised by deformation of an elastic part of the perforating member.

The head could incorporate a manually actuated pump for delivering the product to be dispensed through the dip tube and the dispensing passage.

Such a pump could suck the product up from the container through the dip tube and deliver it to the dispensing passage.

It could equally well be pneumatic and could force air under pressure into the container above the product to be dispensed.

In one embodiment the actuation of the pump is coupled to the perforating member in a manner acting in only one direction and only for the first operation.

According to the use which is envisaged the dispensing passage could lead radially into a side wall of the head and towards the closed end of the perforating member. The dispensing passage could alternatively form an axial extension of the perforating member and open axially at the top of the head.

In numerous cases of use it is useful that the head should have an outlet obturator for closing off the dispensing passage with the aim of avoiding any obstruction of this passage in the event of prolonged non-use of the package after it has been used.

Such an obturator could be actuated by the manual actuating means for raising the product,in such a manner as to disengage itself during dispensing of the product and return to its operative position after dispensing.

The invention will be better understood by sturdy of the following detailed description and examination of the accompanying drawings which illustrate by way of non-limiting example several embodiments of the invention.

In the drawings.

In the drawings the corresponding elements are designated by the same numerical references, in some cases modified by an alphabetical suffix.

Figure 1:
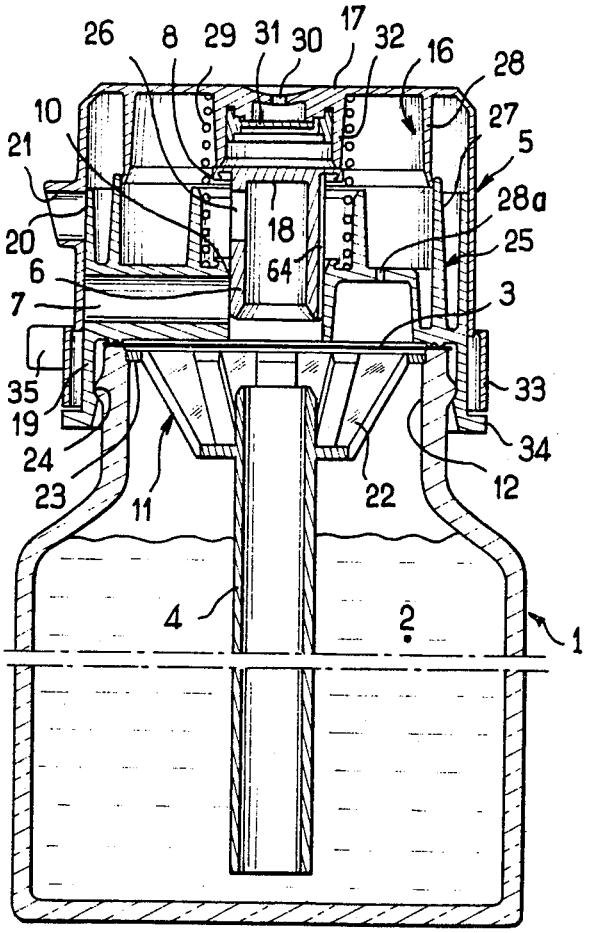
FIG. 1 is a diagrammatic view in axial diametral section of a first embodiment of a package before its first use.
Figure 2:
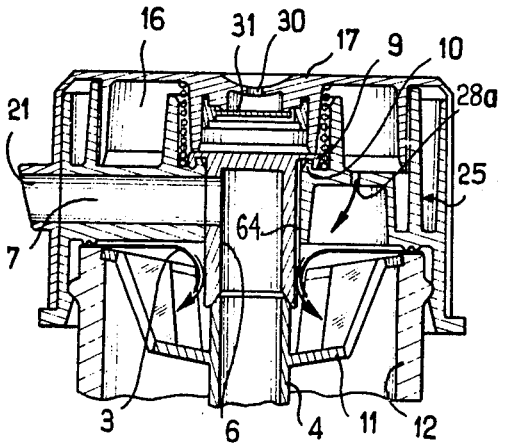
FIG. 2 is a partial view similar to FIG. 1 showing the same package after its first use.
Figure 3:
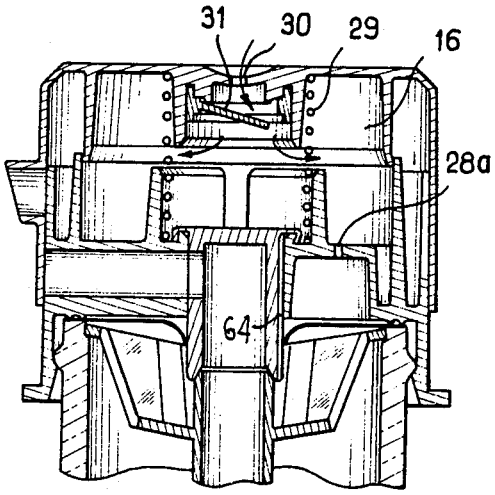
FIG. 3 is a view like FIG. 2 showing the same package returned to the rest position.

The package illustrated in FIGS. 1 to 3 comprises essentially a container 1 in which there is the product 2 to be dispensed. A tube 4 is centered in the neck of the bottle by an annular component 11 in the form of a frusto-conical ring of which the hub, joined to the tube 4, is connected by radial ribs 22 to an outer collar 23 which engages a shoulder adjacent to the mouth of the neck 12 of the container.

The neck of the container is hermetically sealed by a membrane constituted, for example, by a thin sheet made up of a laminate of aluminum material and plastics welded onto the top of the neck 12 of the container. On the neck of the container is a dispensing head 5, fitting by snap engagement onto an external bead 24 on the neck of the container 1. This head 5 comprises essentially a main body 25 pierced by an axial passage in which slides a blind tubular obturator member 6 pierced by a radial hole 26 in the neighbourhood of its closed end 18 which hole, in the inward position (FIG. 2), leads into a radial dispensing passage 7 through the head.

An axial skirt 27 co-operates with a co-axial skirt 28 of the push button 17 to form a pneumatic pump 16 opening into the base of the body 25 through a calibrated orifice 28*a*. A return spring 29 permanently urges the push button 17 towards a position in which it is extended away from the body 25. The top end of the body 17 is pierced by an axial hole 30 communicating with the interior of the pump 16 under the control of a non-return valve 31 arranged in blind axial spigot 32 of which the end comes into engagement with the outside of the closed end 18 of the perforating member 6 before first use (FIG. 1).

The outside wall of the push button 17 is pierced radially by an orifice 21 which comes into line with dispensing passage 7 when the push button 17 is forced downwards (FIG. 2).

At rest, the outer skirt 20 of the body 25 closes off this outlet 21, thus isolating the contents of the container. An annular ring 33 secured to the lower edge of the side wall of the push button 17 by breakable webs engages, through its lower end, against a bead 34 on the body 25 and thus prevents any premature displacement of the push button 17, thereby guaranteeing the integrity of the membrane 3.

A tab 35 facilitates tearing off this tamper-indicating ring 33 before first use.

During first use (FIG. 2), the obturator member 6, acted on by the spigot 32, perforates the membrane 3 and comes into engagement resiliently with the end of the tube 4. The annular component 11 yields elastically and ensures adequate permanent sealing contact between the perforating member 6 and the tube 4.

At the end of the travel of the obturator or perforator member 6 an annular bead 8 on its closed end comes into engagement in an annular rebate 10 of complementary form in the body 25.

From then on the perforator member 6 is permanently connected to the body 25 and remains in place when the push button 17, returned by the spring 29, rises again (FIG. 3).

When the push button 17 is depressed (FIG. 2), the air compressed in the pump 16 is forced through the calibrated orifice 28*a* and creates a pressure above the surface of the product 2 in the container 1, passing between the perforating member 6 and the torn seal 3 via the longitudinal groove 64 in the perforating member, to force the product up through the tube 4 and the passage 7.

The valve 31 prevents the escape of compressed air through the orifice 30. When the push button 17 rises again (FIG. 3) the air enters mainly through then orifice 30, opening the valve 31, but the calibrated orifice 28*a* does not allow the compressed air to return freely into the interior of the pump 16.

Figure 4:
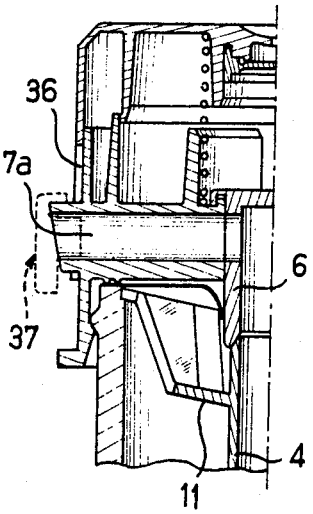
FIG. 4 is a partial view of a modified version of the package of FIGS. 1 to 3, FIGS. 5, 6 7 and 8 are diagrammatic views in diametral section of modifications for the mounting of the dip tube and sealing membranes according to the invention.

In the modification of the pump shown in FIG. 4, the 4 the dispensing passage 7*a* is open permanently to atmosphere through an elongated longitudinal opening 36 in the side wall of the push button 17.

In this embodiment the product which lies stagnant in the tube 4 and the passage 7*a* remains in contact with the atmosphere and it could be useful to envisage a cap, indicated in dotted lines at 37, which the user replaces after each use.

Figure 5:
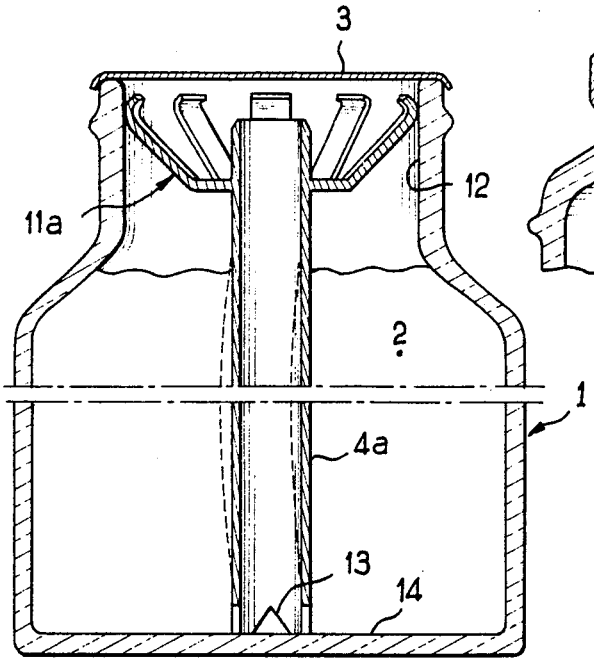

In the modification illustrated in FIG. 5 the dip tube 4*a* rests on the floor 14 of the container 1 at a tip which is cut away as indicated by notches 13 for the passage of the product to be dispensed.

This tube 4*a* is held on the axis of the neck by means of an annular support 11*a* in the form of a star. When the membrane 3 is torn by the perforator member 6 of a head like that of FIGS. 1 to 3 the tube 4*a* flexes axially as indicated in broken lines and ensures by its bowing a resilient sealing contact between the top end of the tube 4*a* and the perforator member 6.

Figure 6:
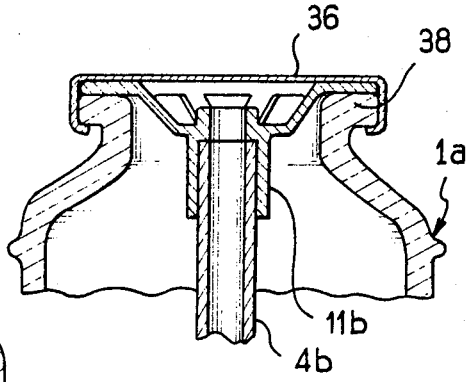

In the embodiment illustrated in FIG. 6 the dip tube 4*b* is held in an axial spigot of an annular member 11*b* like the member 11 of FIGS. 1 to 3, but of which the collar comes into engagement with the outer face of the rim 38 of the neck of the container 1*a*. The membrane seal 3*b* is crimped below the rim 38.

Such a modification could be used in conjunction with the head 5 of FIGS. 1 to 3 and in the same manner.

Figure 7:
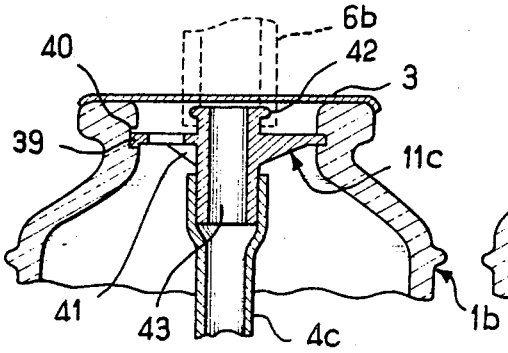

In the version shown in FIG. 7 the annular member 11*c* is constituted by a ring of which the periphery 39 is in snap engagement in a groove 40 inside the neck of the bottle 1*b*. Radial fins 41 holds the annular member 11*c* rigid with the aim of allowing snap-engagement of the end of a perforator member 6*b* on an annular bead 42 in the end of an axial annular conduit 43 of the annular member 11*c*, on which is forced a dip tube 4*c*.

Figure 8:
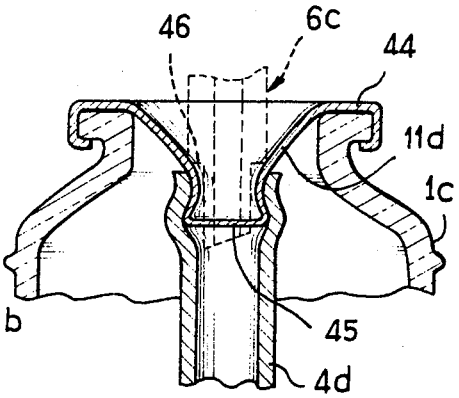

In the version shown in FIG. 8 a cap of aluminum or plastics material 11*d* is fixed onto the end of the neck of the container 1*c* by crimping or snap-engagement with the interposition of an elastic sealing ring 44.

The cap 11*d* is in the form of a frustum of a cone and is extended axially by a tubular spigot 45 with a closed end, over which is fitted a dip tube 4*d*. The end wall of the spigot 45 is preferably of reduced thickness to facilitate piercing by a perforator member 6*c* presenting a shoulder 46 which comes to engage in a sealing manner against the inside of the frustum of a cone forming the capsule 11*d*.

Figure 9:
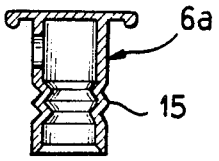
FIG. 9, is a diagrammatic view in axial diametral section showing a variant of the perforating member of the package according to FIGS. 1 to 4.

FIG. 9 illustrates a modification of the perforator member of FIGS. 1 to 3.

According to this modification the perforator member 6*a* has an accordion-pleated part 15 which confers axial elasticity on it, ensuring a well-maintained axial seal against the end of the dip tube 4.

In the embodiment described above the passage of the product up the dip tube, the perforator member and the dispensing tube is free of any obstruction, such as to make the package according to the invention particularly applicable to the dispensing of products which contain solid particles. Furthermore the product which is dispensed does not risk being possibly affected by contact with springs, balls or other metal components.

Figure 10:
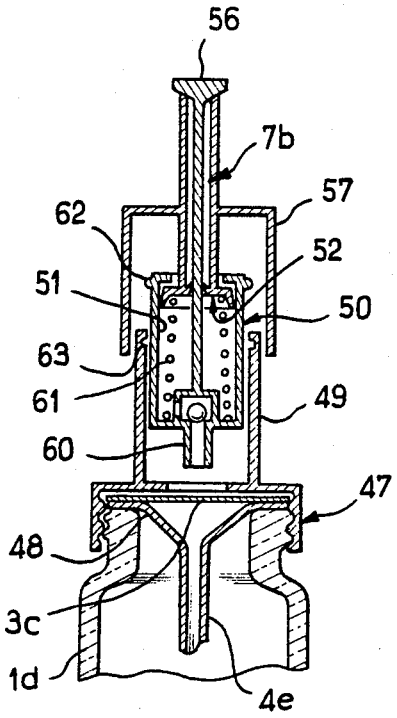
FIG. 10 is a diagrammatic view in diametral section of a package according to the invention fitted with a suction and delivery pump, shown before first use.
Figure 11:
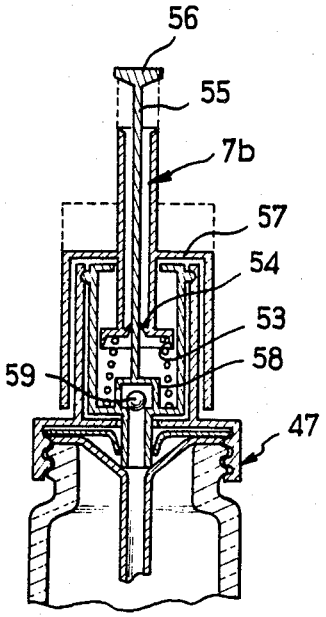
FIG. 11 is a view corresponding to that of FIG. 10, showing the same package after first use.

In the modification illustrated in FIGS. 10 and 11 the base of a cap 47 is screwed onto the neck of a container 1*d*. A dip tube 4*e* is fixed by its end, expanded to form the frusto-conical collar 48, on the face of the neck of the container 1*d* and is covered over by a breakable membrane 3*c*. The cap 47 is extended externally by a tubular part 49 in which slides the barrel 51 of a suction and delivery pump 50. Within the barrel 51 slides a piston 52 which has a peripheral lip 53 in contact with the internal wall of the barrel 51 and an internal lip 54 of inverse shape sliding against an axial stem 55 terminating in an enlarged head 56, against which the end of a dispensing tube 7*b*, joined to a cap 57, engages when at rest, sliding over a tubular part 49. The cap 57 serves as a push button to actuate the piston 52.

The base of the stem 55 is fixed to the top end of a cage 58 enclosing a ball 59 which serves as a non-return valve at the end of an axial tubular extension 60 of the barrel 51, this extension acting as the perforator member the first time the pump is used.

A spring 61 arranged between the piston 52 and the base of the barrel 51 permanently urges the piston 52 towards a rest position in which the end of piston 52 engages in a sealing manner against the head 56 of the stem 55 (as indicated in full lines in FIG. 10 and in broken lines in FIG. 11).

On first use, the barrel 51 is moved in the tubular part 49. The tubular extension 60 perforates the membrane seal 3*c* and comes into sealing engagement against the inside of the frusto-conical spigot, whilst an annular bead 62 on the end of the barrel 51 comes into snap engagement in a positive manner in the inside of an annular groove 63 at the end of the tubular component 49 (FIG. 11).

The pump 50 is then joined to the cap 47 and remains in place when pressure on the cap 57 is released and the latter returns to its rest position indicated in broken lines in FIG. 11.

When pressure is applied to the cap 57 the piston 52 forces the product, previously sucked up into the barrel 51, through the dispensing passage 7*b* of which the end, thus spaced away from the head 56, opens freely to atmosphere.

It will be understood that the invention is by no means limited to the embodiments described and illustrated, but is open to numerous variations available to the expert in the art, according to the use envisaged and without departing for this purpose from the scope of the invention.

I claim:

1. A sterile package for liquid and semi-liquid fluids comprising a container (1) having a neck (12) and containing the product to be dispensed (2) hermetically sealed by a breakable membrane seal (3) until first use and include an axial dip tube (4) extending from below the seal at a first end down to the bottom of the container (1) at a second end, as well as a dispensing head or cap (5) fixed onto the neck (12) of the container and comprising a manually actuated member (6) for perforating the seal and for putting the dip tube (4) at said first end into communication with a dispensing passage (7) which extends through the cap, the package being characterized in that the perforating member (6) is tubular, sliding axially and telescopically at one end of the dispensing passage (7) and comprises snap-engagement means (8) co-operating, at the end of its travel and after perforation of the seal (3), with complementary snap-engagement means (10) on a fixed element of the package to cause the perforating member (6) to engage with the dip tube (4) at said first end in a positive sealing manner, wherein the engagement of the perforating member (6) with the dip tube (4) at said first end is maintained after snap-engagement under an axial elastic pressure exercised by bowing of the dip tube (4), and wherein said second end of said dip tube is notched (13) and engage the floor (14) of the container (1).

2. A package according to claim 1 characterized in that the head (5) contains a manually actuated pump (16) for raising the product to be dispensed (2) through the dip tube (4) and the dispensing passage (7), and wherein the pump (16) sucks up the product (2) in the container (1) through the dip tube (4) and delivers it to the dispensing passage (7).

3. A package according to claim 1, characterized in that the head (5) contains a manually actuated pump (16) for raising the product to be dispensed (2) through the dip tube (4) and the dispensing passage (7), and wherein the pump (16) is pneumatic and delivers air under pressure into the container (1) above the product to be dispensed (2).

4. A sterile package for liquid and semi-liquid fluids comprising a container (1) containing the product to be dispensed (2) hermetically sealed by a breakable membrane seal (3) until first use and including an axial dip tube (4) extending from below the seal down toward the bottom of the container (1), as well as a dispensing head or cap (5) fixed onto the neck (12) of the container and comprising a manually actuated member (6) for perforating the seal and for putting the dip tube into communication with a dispensing passage (7) which extends through the cap, the package being characterized in that the perforating member (6) is tubular, sliding axially and telescopically relative to said head (5) at one end of the dispensing passage (7) and comprises snap-engagement means (8) co-operating, at the end of its travel and after perforation of the seal (3), with complementary snap-engagement means (10) on a fixed element of the package to cause the perforating member (6) to engage with the dip tube (4) in a positive sealing manner, said head (5) including a manually actuated pump (16) for raising the product to be dispensed (3) through the dip tube (4) and the dispensing passage (7), and wherein said pump (16) includes a push button (17) for actuating said pump (16) with said push button (17) coupled to said perforating member (6) to axially slide said member (6) through said seal (3) only in response to movement of said push button upon first operation of said pump (16).

5. A package of claim 4 wherein said perforating member (6) slides relative said dispensing passage (7) upon said first operation of said pump (16).

6. A sterile package for liquid and semi-liquid fluids comprising a container (1) containing the product to be dispensed (2) hermetically sealed by a breakable membrane seal (3) until first use and including an axial dip tube (4) extending from below the seal down toward the bottom of the container (1), as well as a dispensing head or cap (5) fixed onto the neck (12) of the container and comprising a manually actuated member (6) for perforating the seal and for putting the dip tube into communication with a dispensing passage (7) which extends through the cap and which has a mouth (21), the package being characterized in that the perforating member (6) is tubular, sliding axially and telescopically relative to said head (5) at one end of the dispensing passage (7) and comprises snap-engagement means (8) co-operating, at the end of its travel and after perforation of the seal (3), with complementary snap-engagement means (10) on a fixed element of the package to cause the perforating member (6) to engage with the dip tube (4)

in a positive sealing manner, said head (5) including a manually actuated pump (16) for raising the product to be dispensed (3) through the dip tube (4) and the dispensing passage (7), and wherein said pump (16) includes a push button (17) for actuating said pump (16), said head (5) includes an obturator positionable to close the dispensing passage (7), and said obturator is coupled to said push button (17) to be moved clear from said dispensing passage (7) during dispensing of the product and returned after dispensing.

* * * * *